United States Patent [19]

Jacoby et al.

[11] Patent Number: 4,882,831

[45] **Date of Patent: * Nov. 28, 1989**

[54] METHOD OF PRODUCING AIRCRAFT PLATE AND SHEET

[75] Inventors: John E. Jacoby; Ho Yu, both of Murrysville; Robert A. Ramser, New Kensington, all of Pa.

[73] Assignee: Aluminum Company of America, Pittsburgh, Pa.

[ * ] Notice: The portion of the term of this patent subsequent to Feb. 16, 2005 has been disclaimed.

[21] Appl. No.: 138,392

[22] Filed: Dec. 28, 1987

Related U.S. Application Data

[63] Continuation of Ser. No. 941,810, Dec. 15, 1986, Pat. No. 4,724,887, which is a continuation of Ser. No. 850,488, Apr. 11, 1986, Pat. No. 4,709,740, which is a continuation of Ser. No. 550,466, Nov. 10, 1983, Pat. No. 4,610,295.

[51] Int. Cl.[4] ..... B23P 17/00

[52] U.S. Cl. ..... 29/527.5; 164/487

[58] Field of Search ..... 164/487, 5, 128, 486, 164/472; 29/527.5

[56] References Cited

U.S. PATENT DOCUMENTS 2,515,284 7/1950 Ziegler et al. ..... 164/487

4,724,887 2/1988 Jacoby et al. ..... 164/487 X

OTHER PUBLICATIONS

Birdsall, G. W., "Extrusion Plus Forging–Simplifies Aluminum Forming", in *Steel,* Jan. 14, 1952, pp. 54–56.

*Primary Examiner*—Richard K. Seidel

*Assistant Examiner*—J. Reed Batten, Jr.

*Attorney, Agent, or Firm*—Douglas G. Glantz

[57] ABSTRACT

Continuously-cast lithium-containing alloy ingots are produced by a direct chill process including cooling the alloy to form a continuous ingot having a solid shell and further cooling the ingot by direct chill with an organic coolant. The organic coolant in one aspect includes a modified hydrocarbon fluid, e.g., ethylene glycol, having less than a predetermined moisture content. The method includes recirculating coolant while controlling moisture content. An ingot formed by the present invention provides small dendrite arm spacing in a relatively large size ingot. Aircraft plate or sheet is produced from the ingot of the present invention.

3 Claims, 4 Drawing Sheets

METHOD OF PRODUCING AIRCRAFT PLATE AND SHEET

CROSS REFERENCE TO RELATED APPLICATIONS

This application is a continuation of application Ser. No. 941,810 filed Dec. 15, 1986, now U.S. Pat. No. 4,724,887 issued Feb. 16, 1988, which is a continuation of application Ser. No. 850,488 filed Apr. 11, 1986, now U.S. Pat. No. 4,709,740 issued Dec. 1, 1987, which in turn is a continuation of application Ser. No. 550,466 filed Nov. 10, 1983, now U.S. Pat. No. 4,610,295 issued Sept. 9, 1986.

BACKGROUND

This invention relates to the continuous casting of high strength, light metal alloys and to the continuous casting of lithium-containing alloys such as aluminum-lithium alloys.

The process of continuously casting high strength, light metal alloys into acceptable ingots of large size depends on the manner of cooling. Large size ingots include ingots having a cross section larger than about six inches in thickness (e.g., rectangular ingot for rolling mill stock) or larger than about six inches in diameter (e.g., round ingot for forgings or extrusions). Cooling method and rate influence the ingot's tendency to form undesirably brittle or low strength structures, such as edge cracking or surface cracking when the large cross section ingot subsequently is rolled.

Large ingots of high strength light metal are produced conventionally by continuous or semi-continuous direct chill casting using water coolant. A continuous ingot having a solid surface but a core which is still molten is formed in a water-cooled mold. After passing through the mold, water exits directly on the hot solid ingot surface to provide a direct chill cooling. The water then separates or falls from the ingot after extracting heat. Typically, this water is collected in a pool or reservoir in the casting pit.

However, bleed-outs occasionally occur in which molten metal from the ingot core flows through a rupture in the solid wall or shell of the ingot, and liquid metal comes into direct contact with the water. Bleed-outs tend to be more severe with larger size ingots. A Tarset (e.g., a coal tar epoxy) or an equivalent protective coating is applied to steel and concrete surfaces in the casting pit, which surfaces otherwise would be exposed to water and molten metal spilled in the pit. The Tarset provides significant protection from explosion.

Lithium-containing alloys are considered to have substantial promise for high technology applications such as aircraft plate, sheet, forgings, and extrusions. Light metal lithium-containing alloys, such as aluminum-lithium alloys, are highly regarded by reason of material properties such as low density, high strength, high modulus of elasticity, and high fracture toughness. The combination of these material properties can reduce the weight of large commercial airliners by as much as six tons or more. The resulting weight savings can reduce an aircraft's fuel consumption by 220,000 gallons or more during a typical year of operation.

However, a significant processing obstacle stands in the way of the substantial development of large-scale lithium-containing alloy applications such as plate and sheet. This processing problem has prevented the production of a sufficiently large ingot which would permit the formation, e.g., by rolling, of large plates or sheets.

INTRODUCTION TO THE INVENTION

In the case of lithium-containing alloys, e.g., aluminum-lithium alloys, a continuous casting bleed-out which brings molten metal into contact with water has been found to present a substantial risk of violent explosion.

It has been found that a Tarset coating as used in the casting pit in conventional continuous casting of aluminum to prevent explosions provides inadequate protection from aluminum-lithium alloy explosions. None of the protective coatings used conventionally for aluminum alloys with water provides dependable explosion protection for large size aluminum-lithium alloy ingots.

It is an object of the present invention to form relatively large size ingot from high strength, light metal alloy.

A further object of the present invention is to form a continuously cast ingot produced from high strength, light metal alloy; having dendrite arm spacing providing high strength, good fracture toughness, and high modulus; and capable of being fabricated into large lightweight structures, such as rolled plate and sheet, forgings, or extrusions.

Another object of the present invention is to form a continuously cast ingot produced from lithium-containing alloy in a manner as safe as conventional continuous casting processes.

Another object of the present invention is to form a large scale, high quality ingot of lithium-containing alloy while avoiding explosions by providing rapid quenching, including quenching by high nucleate boiling heat transfer and while reducing ingot cracking tendencies by subsequent lower convective heat transfer.

SUMMARY OF THE INVENTION

The present invention provides a method of continuously casting lithium-containing alloy including cooling the alloy sufficiently to form a continuous ingot having a solid shell and further cooling the ingot by direct chill with an organic coolant. The organic coolant in one aspect includes a modified hydrocarbon fluid having less than a predetermined moisture content. A Preferred coolant includes ethylene glycol containing less than about 25 volume percent water and, preferably, less than about 10 volume percent water. The method includes recirculating coolant and controlling its moisture content.

The present invention also provides a continuously cast ingot formed by the direct chill cooling of a high strength, light metal alloy by the method and process of the present invention and, in one aspect, by direct chill cooling with a modified hydrocarbon such as ethylene glycol.

DETAILED DESCRIPTION

Figure 1:
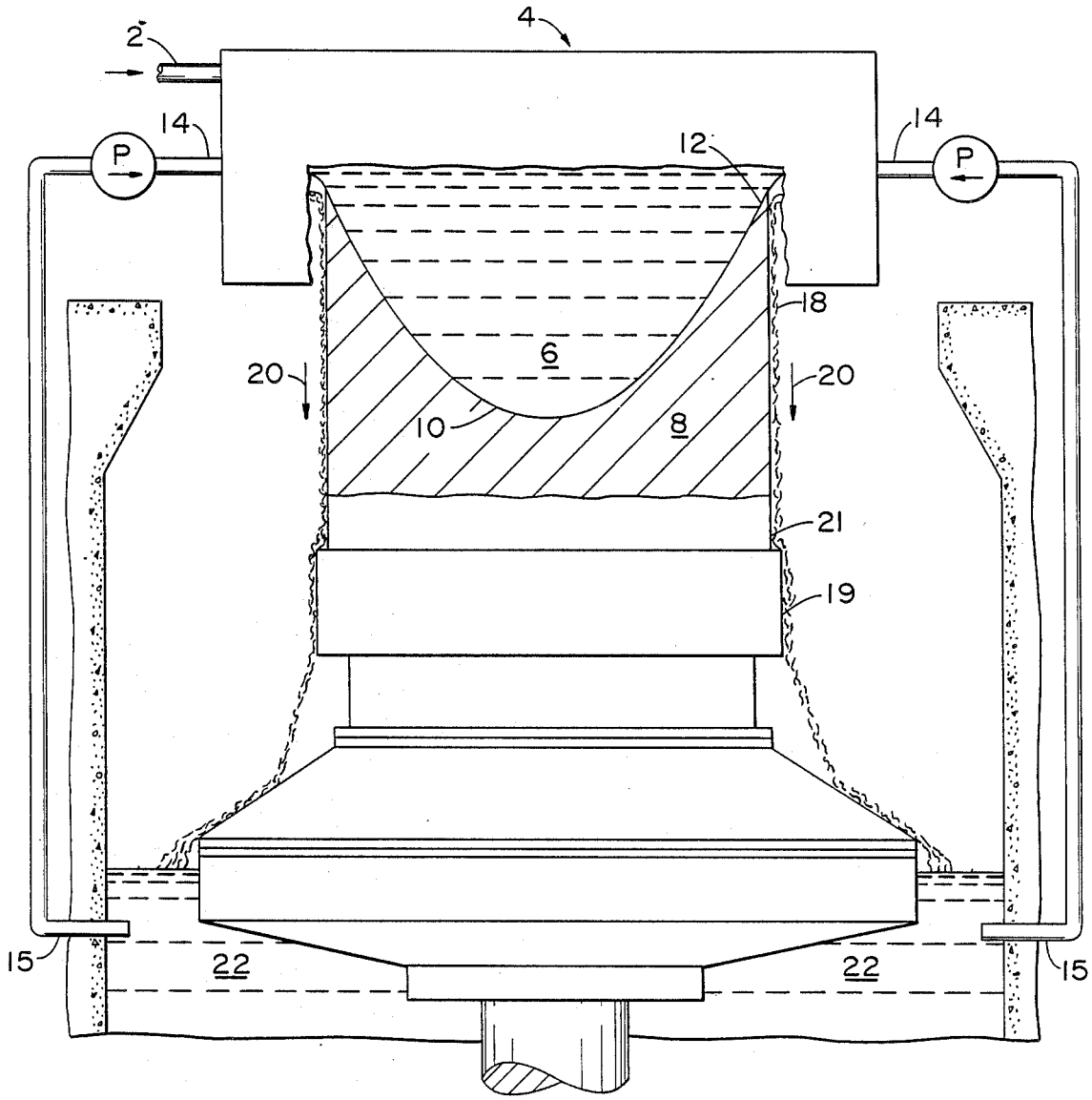
FIG. 1 is an elevation view, partially in section, of a schematic apparatus for the continuous casting of molten metal through a direct chill process.

Referring now to FIG. 1, a schematic apparatus is illustrated for the purpose of describing the present invention as applied to casting an aluminum alloy containing lithium. Molten metal at about 1320° F is passed in line 2 through direct chill casting device 4 to interior 6 of ingot 8. Interior 6 includes a molten pool having solidus line 10 which forms initially as a solid shell 12 at a solidus temperature, e.g., on the order of about 1100° F.

Coolant at a temperature substantially below 1100° F is passed in line 14 to casting device 4 which is adapted to place the coolant in thermal contact, such as including but not limited to heat transfer through a mold surface (not shown), such that molten metal 6 is continuously cast as shell 12.

Starting block 19 initially is placed directly under or inside casting device 4 to form a base 21 of ingot 8. Starting block 19 then is withdrawn to a position under the casting device (as shown) thereby permitting the continuous casting process. Shell 12 grows in thickness while ingot 8 is cooled by direct chill.

FIG. 1 illustrates a vertical continuous or semi-continuous casting process using the direct chill Principle. The process and coolant of the present invention and the product formed thereby also can be employed in a horizontal continuous casting process or in other directional flows of a direct chill process. Detailed descriptions of various embodiments intended to be included in the present process are found in U.S. 2,301,027; U.S. 3,286,309; U.S. 3,327,768; U.S. 3,329,200; U.S. 3,381,741; U.S. 3,441,079; U.S. 3,455,369; U.S. 3,506,059; and U.S. 4,166,495, which are hereby incorporated into this disclosure.

In the embodiment illustrate in FIG. 1, coolant at a temperature, by way of example, of about 120° F is applied at 18 to the surface of shell 12 of the continuously forming ingot. Higher coolant temperatures are operable up to limits imposed by reason of reduced heat transfer and, in the case of lithium-containing alloys, by reason of higher fire hazard attributable to higher vapor pressure in the coolant. For example, a coolant composition comprising ethylene glycol is operable at a temperature of about 180° F or higher, but a lower temperature, below about 130° F such as at about 120° F, is preferred for safety considerations. Vapor pressure is increased significantly from 120° F to 180° F with an accompanying increase in fire hazard. Coolant temperature similarly should be held below a substantial fire hazard temperature for other coolant compositions.

Coolant flows down the solid surface of the ingot as indicated by directional arrow 20 and cools ingot 8 by direct contact or direct chill. The coolant increases in temperature as it flows down the solid ingot surface. Warmed coolant separates from the ingot by falling into the casting pit where it collects as a pool or reservoir 22. Coolant is recirculated in line 15 from reservoir 22 to join line 14. An oil separator (not shown) can be added to separate oil, e.g., mold lubricant oil, from coolant entering line 15.

When casting device 4 incorporates a mold (not shown), a mold lubricant such as castor oil is applied to the casting surface of the mold to reduce the friction between the thin moving ingot shell and the mold, e.g., as illustrated by shell 12 in FIG. 1. Otherwise, the continuously forming ingot may tear on the mold surface. Such tears should be avoided since the tears facilitate bleed-outs of molten metal in direct contact with coolant.

Figure 2:
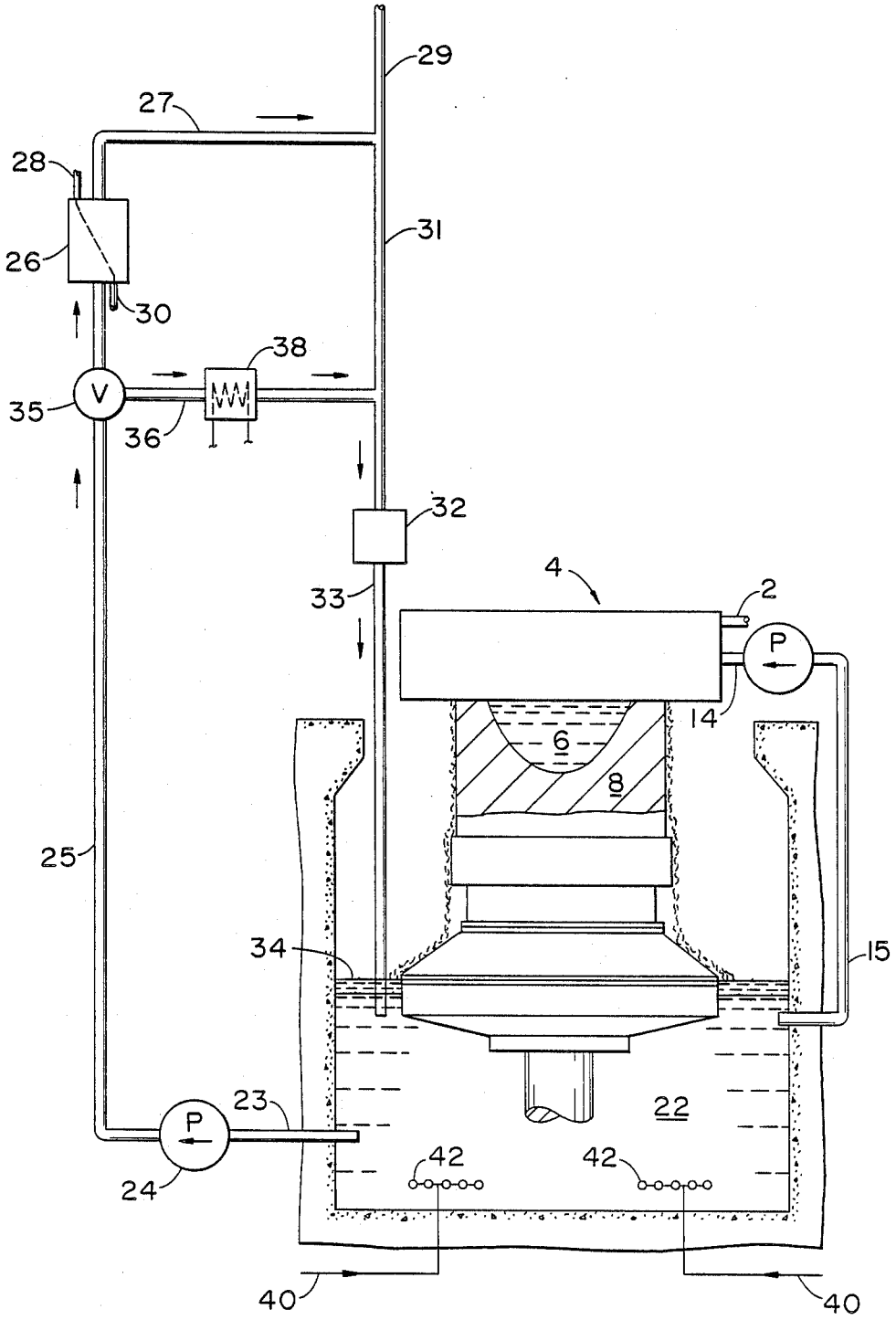
FIG. 2 is a schematic diagram of an overall process system.

Referring now to FIG. 2, warmed coolant collects in the casting pit in pool or reservoir 22. A preferred depth of coolant reservoir 22 is about five feet. The warmed coolant can be cooled by a heat exchange with a secondary coolant. Warmed primary coolant from reservoir 22 is passed in line 23 and is elevated by pump 24 through line 25 to heat exchanger 26 where it is cooled as by indirect heat exchange with a secondary coolant such as water entering the heat exchanger at 28 and exiting in line 30. Cooled primary coolant is recirculated through lines 27 and 31 to reservoir 22 for further use in the continuous casting process.

Certain preferred casting coolants, e.g., ethylene glycol, are hygroscopic, and moisture will accumulate in the coolant, e.g., even when exposed to normal atmospheric conditions. The moisture content of the coolant should be controlled to maintain a preferred level, such as within a predetermined range of water content in the coolant.

Certain hygroscopic casting coolants, e.g., ethylene glycol, are immiscible with certain commonly used casting lubricants, e.g., castor oil. A barrier layer 34 of castor oil or other immiscible lubricant can be provided on the coolant in the reservoir, e.g., by floating. Barrier layer 34 acts as a substantially impermeable barrier to moisture absorption by the ethylene glycol.

Controlling moisture content includes monitoring the moisture such as by determining the refractive index using a commercially available refractometer. For example, recirculated coolant in line 27 or initial or make-up coolant in line 29 is passed in line 31 to refractometer 32 prior to being fed in line 33 to reservoir 22 in the casting pit.

Since it is impractical to prevent some moisture pickup during casting and holding of the coolant in the reservoir, the coolant can be dried by many different drying techniques. One example of a suitable drying technique includes sparging with a dry sparging fluid such as air or any inert, i.e., nonreacting, dry gas. Preferably, sparging is combined with heating, e.g., by actuating diverter valve 35, and passing the coolant in line 36 through heater 38, such as an electric heater, to raise coolant temperature. When large amounts of water are to be removed from the coolant, coolant temperature is raised to a temperature at least above about 200° F at one atmosphere of pressure and preferably above about 210° F. At higher pressures, higher temperatures will be required. For example, when ethylene glycol is used as the coolant, sparging at a temperature at least above the specified temperatures of 200° F and preferably above 210° F will remove significant amounts of moisture in the glycol.

When the coolant has reached the preferred temperature, dry air with a low dew point, e.g., preferably of about −20° C or below, is introduced in line 40 (FIG. 2) at the bottom of the casting pit through spargers 42 capable of introducing a fluid such as dry air into the coolant. As the dry air passes through the moisture-laden coolant, moisture diffuses to the air because of a difference in partial Pressures, and the coolant is dried.

The sparger as illustrated in FIG. 2 is located in the casting pit. This location provides sparging to more coolant than when locating the sparging reservoir separate from the casting pit (not shown). A sparging reservoir separate from the casting pit, on the other hand, facilitates a continuous sparging step while casting. In such a continuous sparging system, warmed coolant may be heated further, sparged, and then cooled prior to introduction into the casting device while direct chill casting continues.

Aluminum-lithium alloy having a lithium content on the order of about 1.2% by weight lithium (Aluminum Association Alloy 2020) conventionally has been cast in a continuous ingot by direct chill with water, i.e., substantially 100% water. However, molten aluminum-lithium alloys containing even slightly higher amounts of lithium, such as about 1.5% to 2% or higher by weight lithium can react with a violent reaction or explosion when brought into direct contact with water as may occur with a bleed-out during a continuous direct chill casting process.

The process of the present invention avoids such a violent reaction and cools the ingot in the direct chill step with organic coolant. Water can be used as the shell forming coolant, if the water is held separate and apart from the molten metal forming into the shell and further if it is not subsequently used to cool the lithium-containing alloy by direct chill. For example, water can be used as a mold coolant separated from contact with the molten lithium-containing alloy.

Further, it has been found that the moisture or water content in the organic coolant must be held below a Predetermined maximum level to avoid explosive reaction when direct chill casting lithium-containing alloys.

Explosion tests were performed by pouring about 23 kg molten metal at about 1400° F into about 14 liters of coolant in a Tarset-coated steel pan. Tested coolants included water, Gulf Superquench 70 (TM) which is a hydrocarbon quench liquid for cooling steel, a phosphate ester selected for high flame resistance, mineral oil, and ethylene glycol at various moisture contents. It was found that ethylene glycol containing water in an amount of substantially more than about 25% by volume in contact with molten aluminum-lithium alloy containing about 2 or more weight percent lithium results in explosion. Explosions did not occur from aluminum-lithium alloy containing 2 to 3 weight percent lithium in contact with ethylene glycol containing less than about 25% water by volume. The predetermined maximum moisture content should be held less than an explosive reaction-forming amount of water, e.g., usually less than about 25 volume percent water, preferably less than about 10% water by volume, and more preferably less than about 5% water by volume in ethylene glycol. However, the explosion limit is somewhat variable over a range of moisture content, including in the range above about 10% to about 25% by volume water, by other factors such as metal temperature, coolant temperature, weight percent lithium in the alloy, molten metal volume, and other explosion-related characteristics. For this reason, it is important to observe and maintain the moisture or water content in the coolant below an explosive reaction-forming amount, i.e., such as an amount which will result in an explosion.

Aluminum-lithium alloy was found to be an ignition source for flammable coolants. In the explosion tests, all of the tested coolants burned when molten aluminum-lithium alloy metal was dropped into the coolant, with the exception of water which produced violent explosion. However, ethylene glycol did not exhibit malodorous characteristics and was found to be self-extinguishing when the heat source was removed. Such features are important safety considerations in the event of a metal spill in a direct chill casting operation. Gulf Superquench 70 (TM) coolant ignited and burned in a self-sustaining manner with a dense black smoke. Ethylene glycol, on the other hand, ignited when mixed with molten aluminum-lithium alloy, but ethylene glycol did not sustain combustion, i.e., the flames extinguished when the heat source was taken away. The phosphate ester in the explosion test had a noxious odor.

The organic coolant should be capable of providing a direct chill comprising an initially rapid quench for shell formation such as by a high nucleate boiling-heat-transfer mechanism and by a subsequent lower convective heat transfer for stress relief. The initial rapid quench provides a shell of sufficient thickness to avoid bleed-outs. Such controlled cooling reduces ingot cracking and provides an advantage in the quality of the ingot produced. Ethylene glycol provides such a controlled cooling, resulting in high quality ingot product for high strength alloys including high strength, light metal alloys of aluminum or magnesium and others. Examples of high strength, light metal alloys which may take advantage of this feature of the present invention are aluminum alloys of 7075, 7050, or 2024, aluminum-lithium alloys and magnesium-lithium alloys.

Numerous modified hydrocarbon fluids can be selected for the organic coolant in a process of the present invention. Such modified hydrocabon fluids include glycols such as ethylene glycol, propylene glycol, bipropylene glycol, triethylene glycol, hexylene glycol, and others, or other modified hydrocarbons such as phosphate ester, mineral oil, and others. Of the glycols, bipropylene glycol provides low hygroscopicity, high boiling point, and high viscosity. Triethylene glycol provides a high boiling point and high viscosity.

Ethylene glycol has been found to provide advantages of superior quenching rate, particularly in the shell formation temperature range of continuously cast ingots of aluminum-lithium alloys. Ethylene glycol also provides a controlled quenching rate in a convective heat transfer zone which reduces the residual stresses generated in the solidified ingot, thereby minimizing any cracking in crack-sensitive aluminum-lithium alloys. This controlled quenching rate also provides an advantage to a continuous casting process for other crack-sensitive aluminum alloys in addition to aluminum-lithium alloys, e.g., such as 7075, 7050, and 2024.

A test missile piece of aluminum 1100 alloy composition in the −F temper having the dimensions of 5.08 cm by 1.26 cm was fitted with a thermocouple of iron-constantan in a 0.159 cm diameter Inconel sheath. The aluminum alloy missile was heated to 1100° F and then was dropped into 900 ml of coolant. Missile temperature was recorded on magnetic tape in a computer. Missile temperature and quench (heat flux) curves were plotted with a Calcomp 565 (TM) plotter. Various coolants were tested, including Gulf Superquench 70 (TM), a hydrocarbon quench for steel cooling; a phosphate ester selected for high flame resistance; ethylene glycol; propylene glycol; mineral oil; and water.

Figure 3:
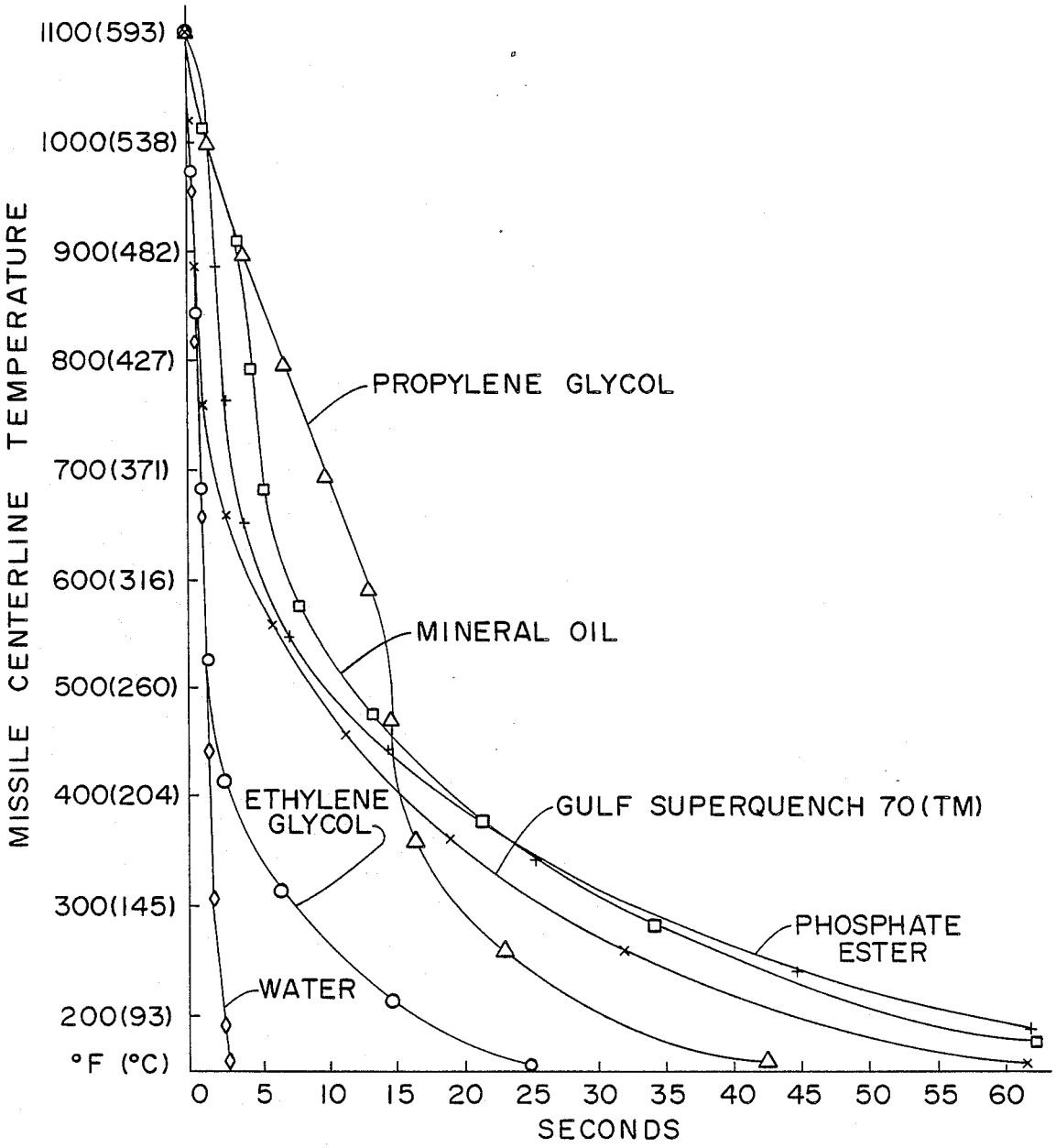
FIGS. 3 and 4 are graphical illustrations of coolant quench curves.

FIG. 3 presents graph depicting missile temperature as a function of time while the missile was quenched by each of the various fluid coolants. Ethylene glycol provided a more rapid quench rate as shown by the lower missile temperatures over less time than the other organic coolants tested.

Figure 4:
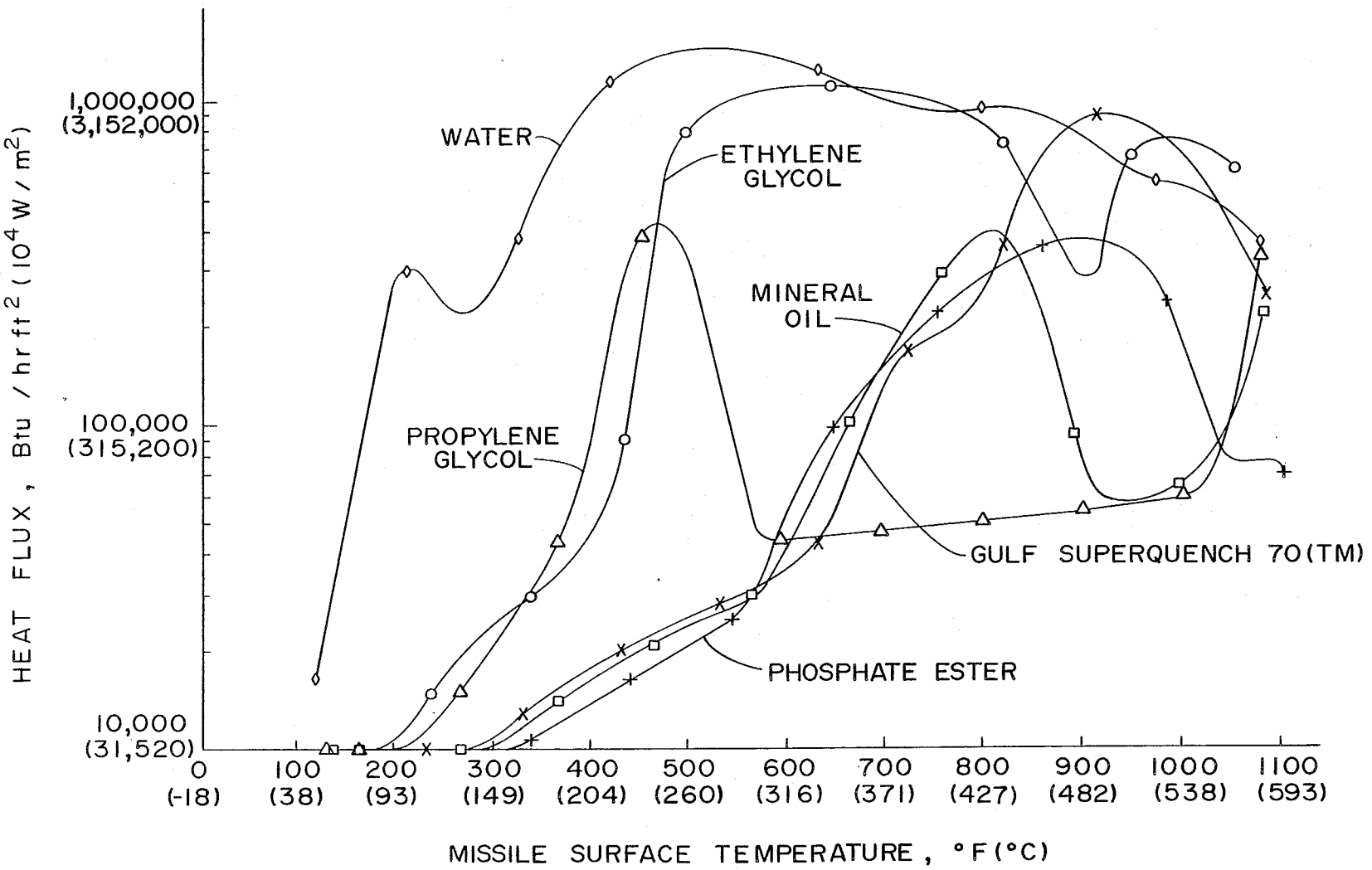

FIG. 4 presents a graphical illustration of a quench curve of each coolant showing heat transfer rate versus temperature. It was found that ethylene glycol provided superior quench rates, particularly in the range of about 900° to 500° F which is the critical range for thick shell formation during the continuous casting of lithium-containing light metal alloys such as aluminum-lithium alloys. In this range, ethylene glycol was found to have a quench capability 10–12 times that of propylene glycol. The superior quenching by ethylene glycol appears to be attributable to a nucleate boiling-heat-transfer mechanism in the particular temperature range of about 900° to 500° F. Gulf Superquench 70 (TM) exhibited a wide film boiling-heat-transfer temperature range which produces an unstable, low heat transfer. The phosphate ester had a narrow boiling-heat-transfer temperature range.

The average quench capability of ethylene glycol over the range of about 1100° F down to 500° F is preferred over that of the other potential coolants. This range encompasses the critical temperature range for forming a strong shell during the continuous casting process for forming aluminum-lithium alloy ingot.

In direct chill casting aluminum-lithium alloy, propylene glycol coolant generates heat transfer rates in the shell formation temperature range as shown in FIG. 4 which are undesirably slower than ethylene glycol. The slower propylene glycol rates are attributable to film boiling heat transfer, and such low rates create large dendrite arm spacing. Ethylene glycol, on the other hand, provides heat transfer rates as shown in FIG. 4 which create significantly smaller dendrites similar to those generated in an ingot cast with water. Moreover, the slower propylene glycol heat transfer rates produce a coarse structure which cannot be eliminated during thermal processing, e.g., macrosegregation, in which the aluminum cools and solidifies in the center of the dendrite while the alloying material is rejected and pushed out to the surface of the dendrite while the metal is solidifying. Thermal treatments or homogenization, as can be performed on microsegregation, cannot dependably cure such a macrosegregation problem. The low propylene glycol heat transfer rates shown in FIGS. 3 and 4 can be modified by higher coolant flow rates on the ingot to break the film boiling-heat-transfer mechanism.

The coolant of the present invention in one aspect Preferably contains a predetermined minimum level of water content. For example, the coolant for casting aluminum-lithium alloy, e.g., ethylene glycol, can be monitored and controlled to contain at least about 1% to about 5% water by volume. The minimum water content generally provides increased heat transfer rates. Such an addition of water also lowers viscosity in many cases such as with ethylene glycol. Lower viscosity and higher heat transfer rates provide more rapid cooling below the shell formation temperatures, and this should be avoided when casting crack-sensitive alloys.

It is somewhat surprising that a glycol would have been a suitable coolant for the continuous casting of lithium-containing alloy. Lithium is known to react with chemicals containing hydroxyl groups. It has been observed, however, that the use of ethylene glycol as a direct chill coolant for the continuous direct chill casting of aluminum-lithium alloy produces only a thin black surface on the ingot, which can be readily removed by washing or scalping. The ethylene glycol is not substantially affected and can be recirculated for further use in the process. Ethylene glycol vapor also is less toxic than other potential coolants.

The higher quench capability of ethylene glycol favors the casting of ingot having large sections. Conventional processes cannot produce lithium-containing alloy ingot safely of large dimensions with acceptable internal structures and at acceptable production rates. Further, larger ingot sizes increase the likelihood of explosion through more severe bleed-outs. Explosion hazards with water and unacceptable internal structures generated by casting methods employing indirect cooling previously have dictated against the casting of large aluminum-lithium alloy ingots which subsequently could be rolled, extruded, or forged into large, high strength structures, e.g., aircraft plate or sheet, even though such products have been particularly desired and are in high demand by reason of high strength to weight characteristics. However, ingots having dimensions up to about 24 inches by 74 inches and larger can be produced by the process of the present invention.

What is claimed is:

1. A method for producing aircraft plate or sheet comprising:
   (a) producing lithium-containing light metal alloy ingot by continuous casting with organic coolant; and
   (b) rolling, extruding, or forging said ingot into aircraft plate or sheet.

2. A method for producing aircraft plate or sheet comprising:
   (a) producing aluminum-lithium alloy ingot of more than about 1.5% lithium by weight by continuous casting with organic coolant to form an ingot larger than about 6 inches' thickness or diameter; and
   (b) rolling, extruding, or forging said ingot into aircraft plate or sheet.

3. The method of claim 2 wherein said continuous casting comprises direct chill casting.

* * * * *